United States Patent [19]

Levin

[11] 4,178,974

[45] Dec. 18, 1979

[54] FLOW CONTROLLER

[75] Inventor: Jonathan S. Levin, Levittown, Pa.

[73] Assignee: RCA Corporation, New York, N.Y.

[21] Appl. No.: 828,751

[22] Filed: Aug. 29, 1977

[51] Int. Cl.[2] ..... B65B 3/36; B65B 3/12; B65B 31/00

[52] U.S. Cl. ..... 141/51; 141/61; 141/67; 141/119; 91/408; 222/394

[58] Field of Search ..... 222/394, 401, 402; 91/408, 409; 141/46, 4, 5, 6, 7, 8, 1, 51, 61, 67, 115, 123, 119, 258

[56] References Cited

U.S. PATENT DOCUMENTS

| | | | |
|---|---|---|---|
| 3,014,620 | 12/1961 | Moore | 222/394 |
| 3,349,859 | 10/1967 | Coy et al. | 141/7 |
| 3,362,222 | 1/1968 | Johnson et al. | 73/198 |
| 3,712,794 | 1/1973 | Farr | 23/259 |
| 3,771,366 | 11/1973 | Thulin | 73/421 B |
| 3,782,197 | 1/1974 | Grams | 73/421 R |
| 3,911,972 | 10/1975 | Hubers et al. | 141/115 |
| 3,937,257 | 2/1976 | Biro | 141/4 |
| 3,943,527 | 3/1976 | Hartmann | 141/258 |

FOREIGN PATENT DOCUMENTS

| | | | |
|---|---|---|---|
| 472545 | 12/1976 | U.S.S.R. | 222/394 |

*Primary Examiner*—Richard E. Aegerter
*Assistant Examiner*—John W. Shepperd
*Attorney, Agent, or Firm*—Samuel Cohen; William Squire

[57] ABSTRACT

Fluid is forced from a reservoir into an evacuated chamber by forcing a plunger into the reservoir. When it is desired accurately to stop the flow of the fluid, the plunger is withdrawn and concurrently the pressure in the reservoir is reduced to that of the evacuated chamber by means of vacuum pump connected to the reservoir.

2 Claims, 1 Drawing Figure

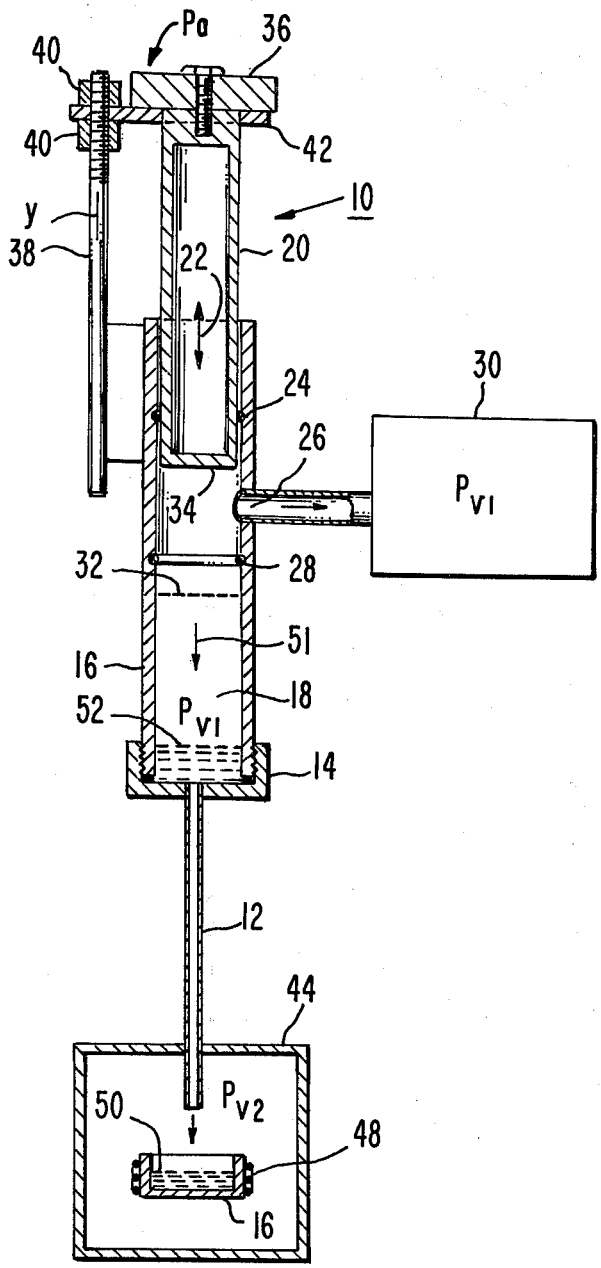
Pa
36
40
40
42
10
y
38
22
20
30
24
26
34
$P_{V1}$
32
28
51
16
18
52
$P_{V1}$
14
12
44
50
$P_{V2}$
48
16

FLOW CONTROLLER

The present invention relates to the control of fluid flowing between high and low pressure systems.

There is a need in a particular application to apply a relatively thin coating of oil in the order of 200 angstroms thick, to the surface of an article. One way this is presently done is to supply a measured amount of oil from a reservoir at atmospheric pressure to a crucible in an evacuated container containing the article, and then heating the crucible for flash evaporating the oil from the crucible, whereby the evaporated oil coats the article.

This method employs a syringe pump which forces oil through a metering valve and a shut-off valve, and then through a syringe needle. The oil passing through the needle drops onto the inner surface of a tube and forms a film which runs through the tube and then passes into the crucible in the evacuated container. When the shut-off valve is closed at the completion of the deposition, any oil on the vacuum side of the shut-off valve, even though relatively minute in volume, continues to flow into the crucible. This continued flow is undesirable as it provides an uncontrolled further deposition of oil on the article to be coated.

Such continued flow is terminated in a system embodying the invention by removing the force on the fluid (such as oil) and concurrently reducing the pressure on the fluid to that within the evacuated container. A shut-off valve, as such, is not needed as the reduced pressure serves to terminate the fluid flow.

IN THE DRAWING

The sole FIGURE of the drawing is a sectional view and partially schematic diagram of a device embodying the present invention.

The device 10 is constructed similarly to a syringe injection device. Device 10 has a narrow gauge tube 12 secured to an end cap 14 which is threaded to a cylindrical tube 16 forming the body of device 10. The tube 12 has its conduit in fluid communication with the cylindrical cavity 18 formed by tube 16. Plunger 20 is cylindrical, closely fitted within cavity 18, and slides in direction 22. O-rings 24 and 28 are located in circumferential grooves in the inner surface of tube 16, one on each side of port 26. O-ring 24 engages the peripheral outer surface of plunger 20 forming a gas tight seal between the plunger 20 and cavity 18. O-ring 28 engages the peripheral outer surface of plunger 20 when plunger 20 is displaced toward cap 14 to position 32 (dashed). When the plunger 20 is in the position shown in the drawing, cavity 18 is at a vacuum pressure $p_{v1}$. The ambient surrounding the tube 16 is, in this example, atmosphere pressure $p_a$. A vacuum $p_{v1}$ in cavity 18 is provided by a suitable vacuum pump 30. The O-ring 24 seals the ambient pressure $p_a$ from the tube 16 cavity pressure $p_{v1}$ to maintain the vacuum within the cavity 18.

When the plunger 20 is in the dashed line position 32 O-ring 28 and the bottom surface 34 of the plunger 20 disconnect pressure $p_{v1}$ produced by pump 30 from cavity 18. In this position plunger 20 has atmospheric pressure $p_a$ on its ambient side and a vacuum on cavity 18 side.

The exposed end of plunger 20 has a disc 36 screwed thereto. Secured to a side of tube 16 is an upstanding post 38. The upper end of post 38 is threaded. A pair of nuts 40 are threaded to the post 38 sandwiching therebetween a retaining plate 42. Plate 42 is C-shaped and rotates about the y axis on post 38. Plate 42 has two positions. One is the plunger retaining position which retains the plunger 20 in the upward extended position as shown in the drawing. In its second position rotated through an angle of some 90 degrees about the y axis of post 38, the plate 42 becomes disengaged from disc 36. In this second position, the plunger 20 is free to move in the direction of arrow 51, and, in fact, is forced in this direction by the pressure differential between $p_a$ and $p_{v1}$.

The tube 12 may be a long piece of thin tubing which terminates within bell-jar 44. Bell-jar 44 is maintained at a vacuum pressure $p_{v2}$ by means (not shown). The pressures $p_{v1}$ and $p_{v2}$ are substantially the same. The tube 12 is disposed above crucible 46 within the bell-jar 44. Oil flows through the tube 12 from a reservoir of oil 52 in a cavity 18 into the crucible 46. A heater 48 heats the crucible causing the oil 50 within the crucible to flash evaporate. The evaporation of the oil then coats an article (not shown) disposed in the bell-jar 44 above the crucible 48.

Oil 52 is deposited in the cavity 18 by removing plunger 20 and inserting the oil through the open end of the tube 16. The oil may have a viscosity of any suitable value. The tube 12 may also have an inner diameter of any suitable value corresponding to the oil viscosity. Oil is merely illustrative. Any fluid may be used. The heater 48 is operated to raise the temperature of crucible 26 to the desired temperature via suitable controls (not shown).

When it is desired to cause the oil to flow into the crucible, the plate 42 is rotated from beneath disc 36 and the pressure differential between the atmospheric pressure $p_a$ and the vacuum $p_{v1}$ forces the plunger 20 against the oil 52. When the plunger 20 engages the O-ring 28, port 26 at this time is effectively closed with respect to cavity 18 between surface 34 and the oil 52. Since the cavity 18 is at a vacuum, the greater atmospheric pressure continues to force the plunger 20 toward the oil. When the plunger 22 reaches the oil 52 it forces this oil through the tube 12 and into the bell-jar 44. The amount of oil present in the cavity 18 need not be measured accurately to obtain a precise coating thickness on the article (not shown). This is done in the present system by measuring the thickness of the oil evaporated on the article to be coated. The thickness measuring device (not shown) may be a crystal monitor, for example. It includes an oscillating crystal within the bell-jar 44, the crystal becoming coated with oil at the same time as the article. The oil coating on the crystal changes the crystal's oscillating frequency and therefore the change in frequency $\Delta F$ may be used as an accurate measure of the coating thickness on the crystal and on the article.

To stop the flow of oil through the tube 12 when the thickness of the oil on the coated article reaches a desired value, the operator immediately raises the plunger 20 to the position illustrated and returns the C shaped plate 42 to the position shown to lock the plunger in place. When the plunger moves past port 26 the cavity 18 is immediately evacuated to the pressure $p_{v1}$. The vacuum pressure $p_{v1}$ in cavity 18 equalizes the vacuum pressure $p_{v2}$ in the bell-jar 44 (assuming $p_{v1}=p_{v2}$, as is the case). This equalized pressure removes the pressure head on the oil 52, immediately stopping the flow of oil from the tube 12 into the crucible 46. Further, because the opening in the tube 12 is relatively small, any residual oil present in the tube 12 does not flow by gravity into the crucible 46 but due to capillary action, remains in position once the port 26 is open to cavity 18. This action permits extremely accurate quantities of oil to be dispensed into the crucible 46.

It is to be understood the invention may be embodied in forms other than that illustrated. For example, while the plunger 20 serves as both a device for forcing the oil through the tube 12 forms a shut-off valve for the port 26, it is apparent that a spearate valve device may be provided for opening and closing the vacuum to the cavity 18. Further, it is also possible to provide a cavity made of a flexible diaphragm responsive to the pressure differential between the ambient and a vacuum. A suitable retaining means can be provided for such a diaphragm for retaining the diaphragm in an extended position. Still other arrangements may be constructed for achieving control of a fluid from a high pressure system to a low pressure system by means of equalizing the pressure across the fluid when it is desired to stop the flow of fluid into the low pressure system.

Also, an automatic system can be provided by providing actuating means responsive to the measured thickness of the deposited oil film for actuating plunger 20.

What is claimed is:

1. In combination:

a fluid reservoir cylinder containing a liquid;

an evacuated chamber;

a hollow conduit between the reservoir and chamber in communication with the liquid, the hollow in the conduit being of sufficiently small cross section that pressure is required to cause said liquid to flow through said conduit;

means including a piston in the cylinder for applying pressure to the liquid for forcing the liquid through the conduit and into the chamber; and means for terminating the flow of liquid comprising means for concurrently removing the pressure applied to the liquid and means for reducing the pressure in the reservoir over the fluid to the same value as is present in the chamber, said means for reducing the pressure comprising evacuation means connected to said cylinder at a point such that said piston operates to block the path between said evacuation means and said cylinder when the piston is applying pressure to said liquid and said piston opens the path between the two when the piston is moved more than a given distance away from the fluid.

2. In combination:

a cylinder, a piston slideably mounted in the cylinder, a cylinder port opened and closed by the piston according to the position of the piston in the cylinder, means for placing the piston in a retracted open port position, a fluid discharge port in fluid communication with the cylinder and one end of the piston, a first source of a fluid at a first subatmospheric pressure, means for connecting the cylinder port to said first pressure source, a second source of a fluid at a second subatmospheric pressure, means for connecting the discharge port to said second pressure source, said piston being in fluid communication with the atmosphere on its other end for selectively displacing the piston to the closed port position in response to the pressure differential between the atmosphere and said subatmospheric pressure on said other and one ends, respectively, said piston forcing fluid in said cylinder through said discharge port when so displaced, said piston opening said cylinder port when returned to its original retracted position to thereby provide said first pressure to said fluid in said discharge port and stopping the flow of said fluid through said discharge port.

* * * * *